US005809106A

United States Patent [19]

Kitade et al.

[11] Patent Number: 5,809,106

[45] Date of Patent: Sep. 15, 1998

[54] X-RAY APPARATUS HAVING A CONTROL DEVICE FOR PREVENTING DAMAGING X-RAY EMISSIONS

[75] Inventors: Koichi Kitade, Otawara; Katsuhiro Ono, Utsunomiya, both of Japan

[73] Assignee: Kabushiki Kaisha Toshiba, Kawasaki, Japan

[21] Appl. No.: 808,857

[22] Filed: Feb. 28, 1997

[30] Foreign Application Priority Data

Feb. 29, 1996 [JP] Japan ..... 8-041984
Feb. 6, 1997 [JP] Japan ..... 9-023372

[51] Int. Cl.[6] ..... H05G 1/00

[52] U.S. Cl. ..... 378/132; 378/117; 378/118

[58] Field of Search ..... 378/114, 117, 378/118, 132, 133, 125, 207

[56] References Cited

U.S. PATENT DOCUMENTS 3,961,173 6/1976 Perry et al. ..... 378/118 X
4,210,371 7/1980 Gerkema et al. .
4,225,787 9/1980 Shapiro et al. .
4,426,720 1/1984 Friedel .
4,562,587 12/1985 Gerkema et al. .
4,641,332 2/1987 Gerkema .
4,644,577 2/1987 Gerkema et al. .
4,856,039 8/1989 Roelandse et al. .
5,068,885 11/1991 Vetter .
5,077,775 12/1991 Vetter .
5,140,246 8/1992 Rarick .

FOREIGN PATENT DOCUMENTS 54-122991 9/1979 Japan ..... 378/118
57-5298 1/1982 Japan .
58-23199 2/1983 Japan .
59-217995 12/1984 Japan .
59-217996 12/1984 Japan .
62-69495 3/1987 Japan .
6-196113 7/1994 Japan .

*Primary Examiner*—David P. Porta
*Attorney, Agent, or Firm*—Pillsbury Madison & Sutro

[57] ABSTRACT

In an X-ray tube with a hydrodynamic slide bearing, an electron beam is caused to strike the focal point track area F on its rotary anode, which then emits X rays. An X-ray emission control device that sets the conditions for emitting the X rays stores as data the rises and drops in the temperature at the electron beam incident point and the other part on the focal point track surface of the anode. On the basis of the data, the input permission or inhibition conditions for the X-ray tube at every moment are calculated and the resulting conditions are displayed on a display unit. As a result, it is possible to perform a computing process in advance to determine whether or not X rays can be emitted under specific conditions without a permitting the rotary anode in the X-ray tube with a hydrodynamic slide bearing to melt and then display the results, thereby enabling a safe, efficient photographing control.

8 Claims, 9 Drawing Sheets

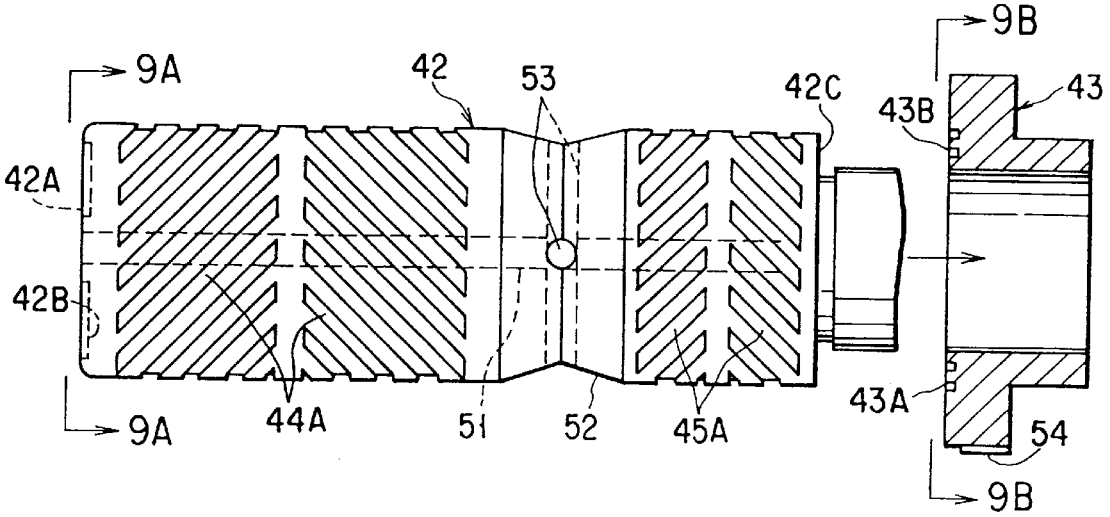
F I G. 8
F I G. 9A
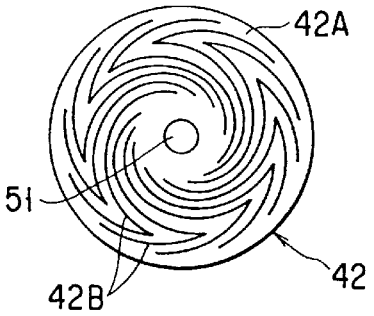
F I G. 9B
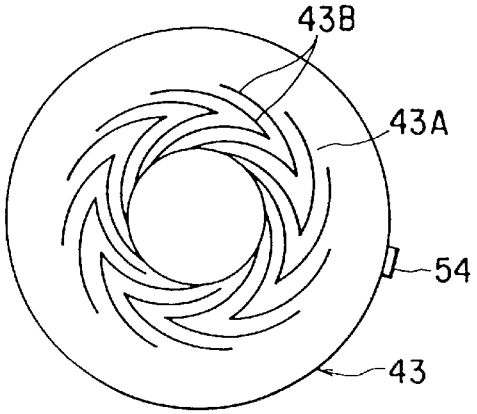

X-RAY APPARATUS HAVING A CONTROL DEVICE FOR PREVENTING DAMAGING X-RAY EMISSIONS

BACKGROUND OF THE INVENTION

This invention relates to an X-ray apparatus, such as a tomograph that photographs tomographic images, and more particularly to an X-ray apparatus with a unit that automatically sets the suitable requirements for causing a rotary anode type X-ray tube to emit X rays safely and efficiently to take X-ray photographs.

In many cases, an X-ray apparatus, such as an X-ray photographing device popularized in the form of CT scanner, an ordinary medical or industrial X-ray photographing device, or an X-ray exposure apparatus, has incorporated a rotary anode type X-ray tube as an X-ray emitting source.

It is well known that with the rotary anode type X-ray tube, the disk-like rotary anode is fixed to a rotary structure mechanically supported by a stationary structure having bearings between the rotary structure and itself, with a stator electromagnetic coil arranged outside the vacuum container so as to correspond to the rotary structure. A rotational driving electric power is supplied to the stator electromagnetic coil, which causes the rotary structure to rotate at high speed, therefore forcing the rotary anode to rotate at high speed likewise. In this state, an electron beam is emitted from the cathode and is forced to impinge on the target section of the anode, which causes the rotary anode to emit X rays.

The bearing section of the rotary anode type X-ray tube is composed of ball-and-roller bearings, such as ball bearings, or of hydrodynamic slide bearings which have spiral grooves made in the bearing surface and uses liquid metal lubricant, such as gallium (Ga) or a gallium-indium-tin (Ga-In-Sn) alloy, that is liquid at least in operation.

Examples of a rotary anode type X-ray tube using the hydrodynamic slide bearings have been disclosed in, for example. U.S. Pat. No. 4,210,371, U.S. Pat. No. 4,562,587, U.S. Pat. No. 4,641,332, U.S. Pat. No. 44,644,577, U.S. Pat. No. 4,856,039, U.S. Pat. No. 5,068,885, U.S. Pat. No. 5,077,775.

A widely-used conventional rotary anode type X-ray tube using ball bearings has a configuration as shown in FIG. 1. Specifically, the disk-like rotary anode 11 is secured to a shaft 12. The shaft 12 is fixed to a cylindrical rotary structure 13 composed of an iron cylinder and a copper cylinder closely engaged with each other. The rotary structure 13 is secured to a rotating shaft 14 arranged therein. Around the rotating shaft 14, a cylindrical stationary structure 15 is arranged. Between the rotating shaft 14 and stationary structure 15, ball bearings 16 are provided.

To increase the heat-accumulating capacity and decrease the weight, the configuration of the disk-like rotary anode 11 is such that a thick graphite ring 11B is bonded to the reverse side of a relatively thin molybdenum (Mo) disk 11A with a brazing material layer 11C. On the tapered surface of the Mo disk 11A, a thin target layer 11D made of a tungsten (W) alloy containing a small amount of rhenium (Re) is formed.

With an X-ray apparatus provided with such a rotary anode type X-ray tube, in the photograph mode in which X-ray radiation is done, the anode 11 supported by the ball bearings is rotated at a high speed, for example, at 150 rps (revolutions per second) or more and an electron beam e emitted from the cathode 17 is forced to impinge on the focal point track surface on the target layer 11D, which then emits X rays (X). The heat generated at the target layer conducts and diffuses to the Mo disk and is accumulated in the graphite ring 11B via the brazing material layer 11C, while dispersing gradually by radiation and conduction.

With the rotary anode type X-ray tube where such ball bearings support the anode, the rotation of the anode can reach a rotational rate close to the maximum rotational rate Rs that can be reached with a relatively small rotational driving torque, as shown by a single-dot-dash line N in FIG. 2. The reason for this is that the rotational resistance of the ball bearings is relatively small. Since wear of the lubricant for the bearings and the related surfaces is liable to take place in the X-ray tube provided with the ball bearings, the anode is stopped from rotating when photographing is not effected. Immediately before a photograph is taken, the rotation of the anode is started and caused to reach the aforementioned high rotational rate in a short time. When the rotation of the anode has reached a high rotational rate, X rays are emitted. After photographing has been completed, electrically applying the brakes causes the rotational rate of the anode to decrease swiftly and the anode to come to a stop.

In contrast to the rotary anode type X-ray tube with ball bearings, a rotary anode type X-ray tube where the anode is supported by hydrodynamic slide bearings has the advantage of supporting a heavier anode target stably. This, however, leads to large bearing resistance, so that a substantially large rotational driving torque is needed to cause the rotation of the rotary structure to reach its maximum attainable rotational rate Rs. For the need for a design that does not make the rotational driving electric power unnecessarily large, the X-ray apparatus provided with the rotational anode type X-ray tube having the hydrodynamic slide bearings does not use a mode that raises the rotational rate rapidly in such a manner that the anode is started from a standstill in a short time. The anode is kept rotating continuously at a rotational rate of, for example, about 50 to 60 rps. The operation is controlled so that X-ray radiation may be done at any time at the rotational rate.

In recent years, it is common practice to take tomographic photographs of the subject consecutively for several tens of seconds in the intermittent mode or the helical scanning mode with, for example, a CT scanner. When X rays are emitted from the rotary anode type X-ray tube for a long time as described above, a rise in the temperature of the anode in the X-ray tube often puts a limit on the continuation of the emission of X rays.

Specifically, the temperature (Tf) of the rotary anode 11 in the X-ray tube at a certain point in time in the focal point track area (F) shown by dashed lines rises with the duration of the emission of X rays as shown in FIGS. 3A and 3B. The incident point (P) of the electron beam at that time, that is, the temperature (Tp) at the X-ray focal point, naturally reaches a much higher temperature than the temperature (Tf) in the focal point track area.

Here, the temperature (Tf) in the focal point track area represents the average temperature at a certain point in time in the focal point track area excluding the electron beam incident point (P). The temperature (Tp) at the electron beam incident point represents the highest temperature at a certain electron beam incident point that has been reached at that moment. The temperature (Tf) of the focal point track area rises as a result of the heat being accumulated on the basis of the difference between the amount of input heat by the electron beam incident on the anode and the amount of dispersing heat by heat dissipation. The temperature (Tf)

drops by heat dissipation. Since the Mo disk 11A as the base for the anode and the target layer 11D of a W alloy containing Re are bonded to each other metallically closely and stably by forging and both of the metals have relatively large heat transfer rates, the heat developed at the target section conducts and disperses immediately. As a result, the average temperature of the Mo disk in the focal point track area and its vicinity is almost uniform.

In contrast, the temperature (Tp) at the electron beam incident point arrives at the peak temperature only at the time of the incidence of the electron beam as a result of the amount of momentary input heat by the incidence of the electron beam being added to the temperature (Tf) in the focal point track area. Because a temporary heat-accumulating action at the electron beam incident point differs with the rotational rate of the anode, the temperature (Tp) at the electron beam incident point is strongly influenced by the rotational rate. Specifically, when the temperatures (Tp) at the electron beam incident point are compared in a case where temperatures (Tf) develop in the same focal point track area, the temperature (Tp) at the electron beam incident point reaches a higher temperature as the rotational rate of the anode is lower. As the rotational rate of the anode is higher, the temperature (Tp) at the electron beam incident point drops to a lower temperature accordingly.

A method of predicting the change of the anode base average temperature corresponding to the temperature (Tf) in the focal point track area to determine allowable input conditions or of setting a lock to prevent the emission of X rays, or an X-ray apparatus having control means similar to that method have been disclosed in Jpn. Pat. Appln. KOKAI Publication No. 57-5298, Jpn. Pat. Appln. KOKAI Publication No. 58-23199, Jpn. Pat. Appln. KOKAI Publication No. 59-217995, Jpn. Pat. Appln. KOKAI Publication No. 59-217996, Jpn. Pat. Appln. KOKAI Publication No. 62-69495, Jpn. Pat. Appln. KOKAI Publication No. 6-196113, U.S. Pat. No. 4,225,787, U.S. Pat. No. 4,426,720, and U.S. Pat. No. 5,140,246.

When tomographic images are photographed by emitting X rays continuously in, for example, the helical scanning mode, the temperature of the anode in the X-ray tube varies with time as shown in FIGS. 4A and 4B. The abscissa axis in FIGS. 4A and 4B represents time (t) and the ordinate axis represents the temperature of the anode. Tr on the ordinate axis is the temperature of the anode at the beginning of the operation which corresponds to room temperature. Ts on the ordinate axis is the tolerance limit temperature of the anode.

The tolerance limit temperature Ts is the upper limit temperature that assures a stable operation in which the rotary anode does not melt even locally. For example, in the case of the anode with a W or W alloy target layer, the tolerance limit temperature is usually set at a temperature lower than its melting point with a suitable allowance, for example, at 2800° C.

As an example, the temperature rise of the rotary anode is shown by a curve between time "a" and time "b" on the time axis in FIG. 4A, when X-ray radiation is effected with the electron beam acceleration voltage or anode voltage of the X-ray tube being set at 120 kV, the electron beam current at 0.2 A, and the X-ray emission duration at 20 seconds. The average temperature Tf in the focal point track area is raised gradually from almost room temperature Tr. To make it easier to understand the figure, the temperature (Tp) at the electron beam incident point is represented by the temperature at a certain point on the target layer of the anode. Specifically, because the anode rotates at a certain constant rotational rate and the rotation of the anode causes a certain point on the focal point track to pass the electron beam incident point repeatedly, the temperature (Tp) is raised momentarily each time the certain point passes the incident point. FIG. 4A illustrates the change of the state at that time.

After the emission of X rays under the aforesaid input conditions has been completed, the heat accumulated on the anode is dissipated by radiation and conduction, so that the average temperature Tf in the focal point track area drops gradually. A temperature drop curve due to the heat dissipation of the anode is shown by Tu. Thereafter, when the emission of X rays is started again from a certain point in time c under the same input conditions as described above and the emission is continued for, for example, 30 seconds, the temperature of the anode begins to rise from the average temperature in the focal point track area at the beginning time c. At time d that the emission of X rays has finished, the average temperature in the focal point track area starts to drop from the reached temperature.

As another example, FIG. 4B shows a case where X rays are emitted under input conditions where the anode acceleration voltage of the X-ray tube and the X-ray emission duration are the same as in the above example and the electron beam current is raised to 0.3 A. As might be expected, the average temperature (Tf) in the focal point track area and the temperature (Tp) at the electron beam incident point rise more rapidly and reach higher temperatures than those in FIG. 4A.

Under the operating conditions of FIG. 4B where the amount of input heat to the anode is large as described above, the temperature (Tp) at the electron beam incident point exceeds the tolerance limit maximum temperature Ts at time g in the course of continuing a second emission of X rays. Because a further continuation of the emission would result in the melting of the focal point track area, the incidence of the electron beam or the emission of X rays to the anode must be stopped at time g. Although it is almost impossible to measure the peak temperature at the electron beam incident point accurately and control the input to the anode, it is possible to predict the temperature change accurately through calculations on the basis of the heat transfer rate of each part of the anode, the heat-accumulating characteristic, the heat-dissipating characteristic, the rotational rate, and the electron beam input conditions including the anode voltage, electron beam current, and input time.

In the prior art, however, although the above-described thermal characteristics of the anode have been taken into account, a method of performing control by predicting future input conditions on the basis of the prediction of the average temperature of the base section of the anode has been employed. In the case of an anode where a graphite disk is bonded to a Mo disk with a brazing material or an anode where the target layer is bonded to the surface of a graphite disk with a brazing material, the allowable input is limited to a very low level because of the instability of the brazed joint between the graphite disk and the Mo or W section.

Specifically, the melting points of the component parts of the conventional anode are as follows: W has a melting point of 3410° C., Mo has a melting point of 2625° C., graphite has a melting point of 3700° C., and a brazing material made of a combination of, for example, Zr, W, and Ni, has a melting point of about 1700° C. Furthermore, W has a thermal conductivity of about 130 (W/m.K), Mo has a thermal conductivity of about 140 (W/m.K), and graphite has a thermal conductivity of about 50 (W/m.K). Still further, W has a thermal expansion coefficient of about $7\times10^{-6}$, Mo has a thermal expansion coefficient of about $5\times10^{-6}$ and graphite has a thermal expansion coefficient of about $3\times10^{-6}$.

Because of these properties, with the aforesaid conventional graphite junction-type rotary anode, the melting point of the brazing material is much lower than those of W and Mo and the thermal conductivity and thermal expansion coefficient of the brazing material differ from those of W and Mo, so that a crack in the brazed section and damage to the brazed section by, for example, melting, are the chief factors that limit the input to the anode to a low level.

For this reason, although a substantially high input is possible for subsequent photography with the conventional apparatus, only low input is permitted, resulting in a low operating efficiency. Since with the X-ray tube where the rotary anode is supported by the hydrodynamic slide bearings as described earlier, it is practically difficult to rotate the anode at a high speed, for example, at 150 rps, the above-mentioned limits are more significant.

BRIEF SUMMARY OF THE INVENTION

The object of the present invention is to provide an X-ray apparatus capable of controlling the photographing operation safely and efficiently by making calculations every moment to determine whether or not the emission of X rays is possible under specific conditions without causing damage to the rotary anode in an X-ray tube with hydrodynamic slide bearings.

According to one aspect of the present invention, there is provided an X-ray apparatus comprising: an X-ray tube including: a rotary anode having an X-ray emitting target; a cathode that emits an electron beam toward the target of the rotary anode; a rotary structure to which the anode is secured; a stationary structure that engages concentrically with the rotary structure; and a hydrodynamic slide bearing which has helical grooves in an engaging section of the rotary structure and stationary structure and to which a liquid-metal lubricant with a specific melting point is applied; a stator arranged around an outside periphery of the X-ray tube; a rotational driving power supply device that supplies a rotational driving electric power to the stator; an X-ray tube power supply device that causes an electron beam to strike a focal point track area on the rotary anode in the X-ray tube; and an X-ray emission control device that controls an operation of the X-ray tube power supply device and sets conditions of X-ray emission, wherein the X-ray emission control device includes: first prediction means that predicts how a temperature at an electron beam incident point on the focal point track area and an average temperature of the focal point track area rise with time for the anode voltage, electron beam current and the electron beam incidence duration in a case where an electron beam is caused to strike the focal point track area on the rotary anode in the X-ray tube; second prediction means that predicts how the average temperature of the focal point track area falls with time from the reached average temperature of the focal point track area by heat dissipation in a case where the electron beam incidence is stopped; and notifying means for notifying at every moment input permission conditions to the X-ray tube obtained on the basis of prediction results from the first and second prediction means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 8 is a side view of parts of the stationary structure and the rotary structure constituting the hydrodynamic slide bearing of FIG. 7;

FIGS. 9A and 9B are top views of the herringbone patterns of the hydrodynamic slide bearing of FIG. 8;

DETAILED DESCRIPTION OF THE INVENTION

Figure 5:
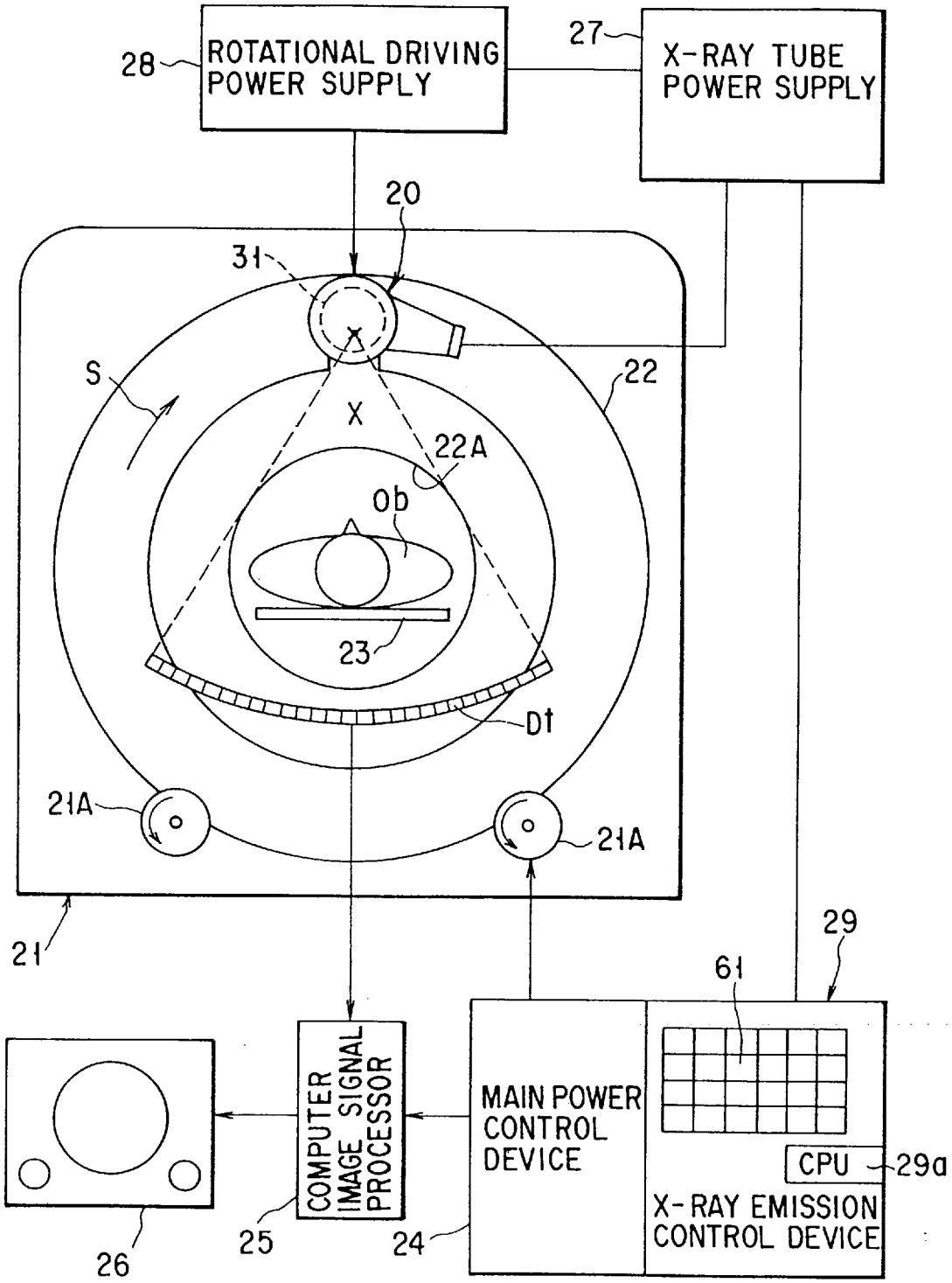
FIG. 5 is a schematic block diagram of an X-ray apparatus according to an embodiment of the present invention.

Hereinafter, referring to the accompanying drawings, an X-ray apparatus according to an embodiment of the present invention will be explained. The same parts are shown by corresponding reference characters throughout the drawings. A CT scanner or a tomograph, whose schematic configuration is shown in FIG. 5, has a ring-like rotary frame 22 provided on a gantry 21 in such a manner that the frame 22 can rotate. Inside a dome 22A formed in the central section of the rotary frame 22, an advancing and retreating bed 23 and a subject for photography Ob put on the bed are housed. The rotary frame 22 is rotated around the subject Ob in the direction of arrow S by a rotational driving device 21A operated under the control of a main power control device 24.

An X-ray tube device 20 that emits a fan beam of X rays (X) (shown by dashed lines) toward the subject Ob is provided in a specific position on the rotary frame 22, on the opposite side of which an X-ray detector Dt is arranged and is rotated around the subject Ob during taking X-ray photographs, keeping the positional relationship. The X-ray image signal obtained from the X-ray detector Dt is supplied to a computer image signal processor 25, which then makes calculations on the basis of the signal and sends the resulting image output signal to a CRT monitor 26, which then displays a tomogram of the subject Ob.

The X-ray tube device 20 has a rotary anode type X-ray tube 31 secured to the inside of the device 20. An X-ray tube power supply 27 and a rotational driving power supply 28 output a rotating and operating electric power to the X-ray tube 31.

With the CT scanner, an X-ray emission control device 29 controls the rotation and X-ray emission of the X-ray tube 31. The X-ray emission control device 29 is provided with a control panel 61 explained later.

Figure 6:
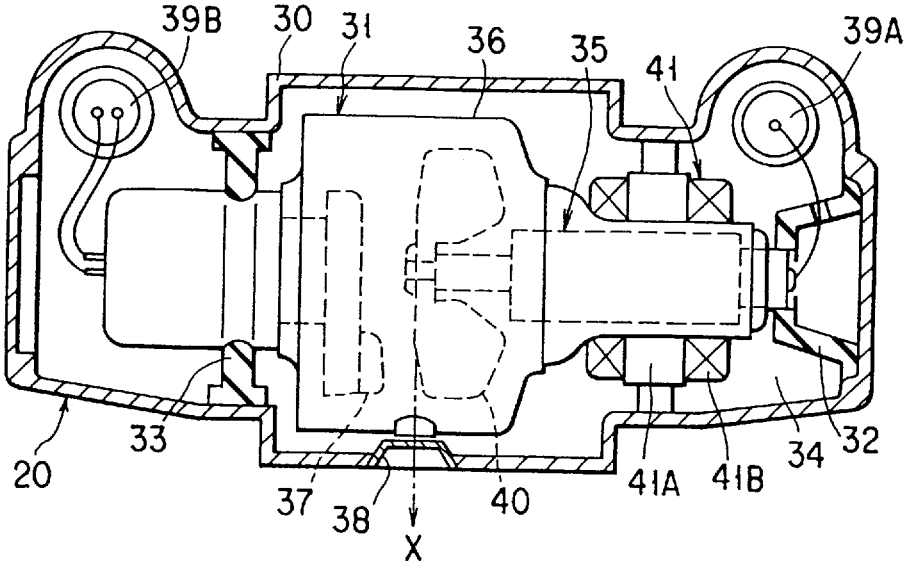
FIG. 6 is a schematic longitudinal sectional view of the X-ray tube device of FIG. 5.

The X-ray tube device 20 and the rotary anode type X-ray tube 31 with a hydrodynamic slide bearing have the configurations shown in FIGS. 6 to 9B. Specifically, the X-ray tube device 20 has the rotary anode type X-ray tube 31 fixed by insulating supports 32, 33 inside an X-ray tube container 30. An insulating oil 34 is filled in the internal space of the container 30. Furthermore, the X-ray tube device 20 is provided with a stator 41 for rotating the rotary structure 35 of the X-ray tube 31 and the rotary anode 40 that emits X rays. In FIG. 6, reference numeral 36 indicates the vacuum container of the X-ray tube; 37 a cathode; 38 an X-ray emitting gate; 39A an anode-side connection cable receptacle; and 39B a cathode-side connection cable receptacle. In FIG. 5, the CT scanner 22 and X-ray tube 31 are installed so that the direction of the central axis of rotation of the CT scanner's rotary frame 22 and the direction of the central axis C of the X-ray tube 31 may be parallel or almost parallel with each other.

As shown in FIGS. 7 to 9B, the rotary anode type X-ray tube 31 is provided such that a disk-like rotary anode 40 made of a heavy metal is fixed integrally to a shaft 35A provided at one end of the cylindrical rotary structure 35 inside the vacuum container 36. The cathode 37 that emits an electron beam e is arranged so as to face the tapered focal point track surface of the rotary anode 40.

A cylindrical stationary structure 42 is engaged concentrically with the inside of the cylindrical rotary structure 35. A thrust ring 43 is secured to the opening of the rotary structure. The end of the stationary structure 42 is an anode terminal 42D, part of which is hermetically joined to the glass cylindrical container section 36A of the vacuum container 36. The engaging section of the rotary structure 35 and the stationary structure 42 is provided with a pair of radial hydrodynamic slide bearings 44 and 45 and a pair of thrust hydrodynamic slide bearings 46 and 47 as disclosed in the aforementioned publications.

The radial hydrodynamic slide bearings 44, 45 are composed of two pairs of herringbone helical grooves 44A, 45A made in the outside-periphery bearing surface of the stationary structure 42 and the inside-periphery bearing surface of the rotary structure 35. One thrust hydrodynamic slide pressure bearing 46 is composed of a circular herringbone helical groove 42B as shown in FIG. 9A made in the tip bearing surface 42A of the stationary structure 42 and the base of the rotary structure 35. FIG. 9A is a plan view taken along line 9A—9A of FIG. 8. The other thrust hydrodynamic slide bearing 47 is composed of a circular herringbone helical groove 43B as shown in FIG. 9B made in the tip bearing surface 43A of the thrust ring serving as part of the rotary structure 35 and the bearing surface 42C of the shoulder of the stationary structure 42. FIG. 9B is a plan view taken along line 9B—9B of FIG. 8. The helical grooves made in the bearing surface of each bearing constituting each bearing has a depth of about 20 $\mu$m.

The bearing face of each bearing for each of the rotary structure 35 and stationary structure 42 is designed to keep a bearing clearance of about 20 $\mu$m in operation. In the stationary structure 42 on the central axis of rotation C, a lubricant holder 51 made of a hole bored in the center of the stationary structure 42 in the axial direction is formed. The outside-periphery wall in the middle of the stationary structure 42 is tapered slightly to form a smaller-diameter section 52. Part of the lubricant is accumulated in the cylindrical space produced by the smaller-diameter section 52.

An emission direction passage 53 leading from the lubricant holder 51 in the middle of the stationary structure 42 to the space of the smaller-diameter section 52 is formed symmetrically at the same angle. A liquid-metal lubricant made of Ga-In-Sn alloy is supplied to the clearance between the rotary structure 35 and the stationary structure 42, each bearing groove, the lubricant holder 51, the space of the smaller-diameter section 52, and the internal space including the emission direction passage 53.

The primary section of the rotary structure 35 is composed of a three-layered cylinder: the innermost cylinder 35A is a bearing cylinder of iron alloy, the middle cylinder 35B is a ferromagnetic cylinder made of iron, and the outermost cylinder 35C is a copper cylinder. These cylinders 35A to 35C are engaged and joined integrally with each other. In cooperation with the magnetic coil 41B of the stator 41 arranged around the outside of the glass cylindrical container section 36A surrounding the rotary structure 35, the cylinders 35A to 35C function as the rotor of the electromagnetic induction motor. The stator 41 is provided with a cylindrical iron core 41A and a stator coil 41B wound around the core 41A. As described earlier, the stator driving power supply 28 supplies a rotational driving electric power to the stator coil 41B, which generates a rotational torque in the rotary structure 35 in the X-ray tube 31.

The rotary anode 40 in the X-ray tube 31 is not an anode part of which is provided with graphite, but an anode having a base 40A made of high-melting point metal, such as Mo or Mo alloy, whose diameter is, for example, 150 mm and whose thickness is 30 mm at maximum, and a heavy-metal target layer 40B for emitting X rays made of W or W alloy containing Re, whose thickness is 1.5 mm and which is formed integrally with the tapered surface of the base 40A by means of, for example, a forging process. As described above, the cathode 37 that emits an electron beam e is arranged so as to face the focal point track area F of the anode 40. X rays generated at the electron beam incident point on the focal point track area are emitted from an X-ray emitting window 38 that is part of the vacuum container.

The rotary anode 40 is not limited to the structure where the base section 40A and the target section 40B are made of different metals. For instance, the rotary anode 40 may be such that the base section 40A and the target section 40B are made of a single Mo or Mo alloy, as found in a rotary anode type X-ray tube for mammography.

Figure 7:
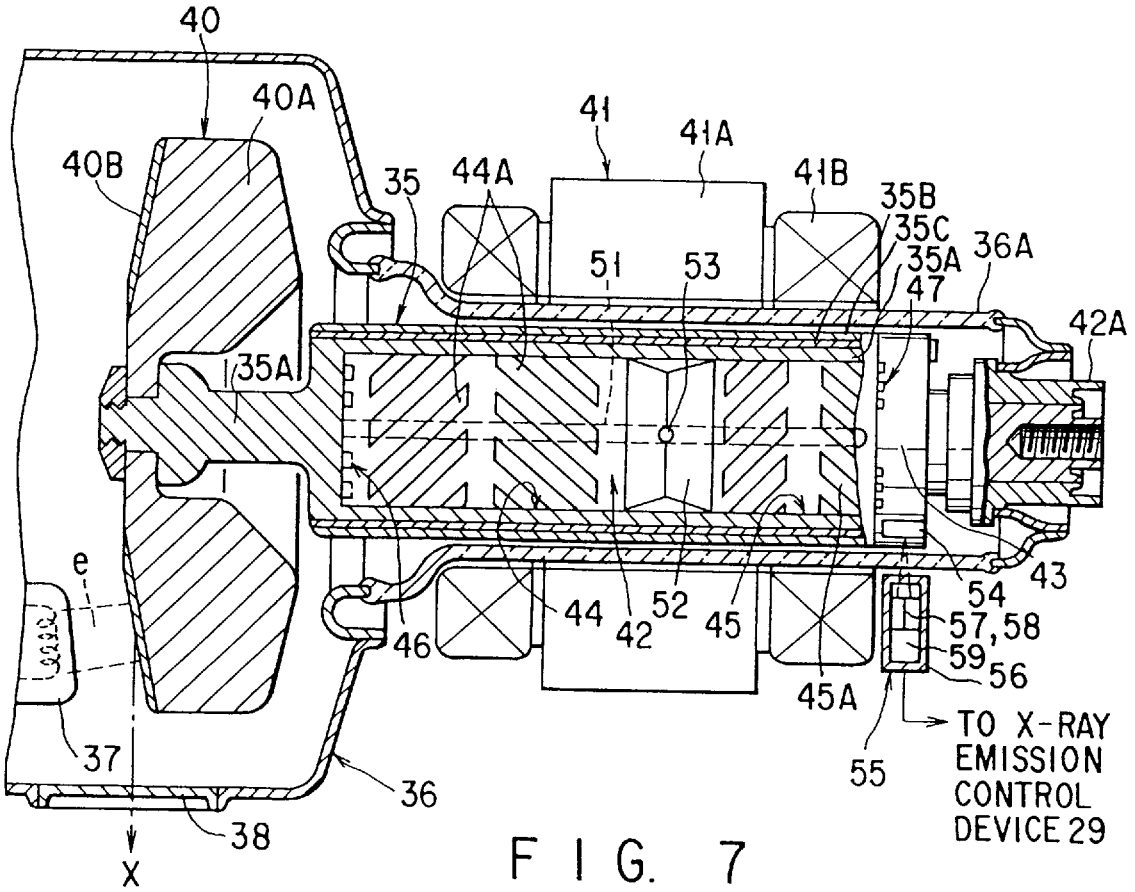
FIG. 7 is an enlarged longitudinal sectional view of part of the X-ray tube of FIG. 6.

Furthermore, in the embodiment, a black mark 54 is stuck to part of the outside-periphery surface of the thrust ring 43 constituting the bottom end of the rotary structure 35, and is located in a position that can be seen from outside the tube through the glass container section 36A of the vacuum container 36. In the position outside the glass container section 36A corresponding to the mark 54, a sensor 55 that senses the rotational rate of the rotary structure 35 is provided. With the rotational rate sensor 55, a laser light oscillation element 57 and a light-receiving element 58 that receives the laser light reflected from the surface of the rotary structure 35 are arranged in a case 56 made of an X-ray shielding material as shown in FIG. 7. The rotational rate sensor 55 includes a signal processing section 59 that not only controls the operation of both elements 57 and 58 but also amplifies the received signal and makes calculations. These devices are electrically or optically connected to the rotational driving power supply 29 that supplies a rotational driving electric power and the X-ray emission control device 29 that controls the emission of X rays from the X-ray tube 31. The signal corresponding to the rotational rate is generated at the sensor 55, which supplies the signal to the power supply 28 and the control device 29.

The sensor 55 projects a laser beam onto the surface of the rotary thrust ring 43 through the laser light gate provided on the case 56. The laser beam reflected from the rotary thrust ring 43 is received by the sensor 55. By sensing the level of low reflection intensity produced at the time when the laser beam has struck the black mark 54, the rotational rate of the rotary structure 35 is determined through calculations on the basis of the sensed level.

Figure 10:
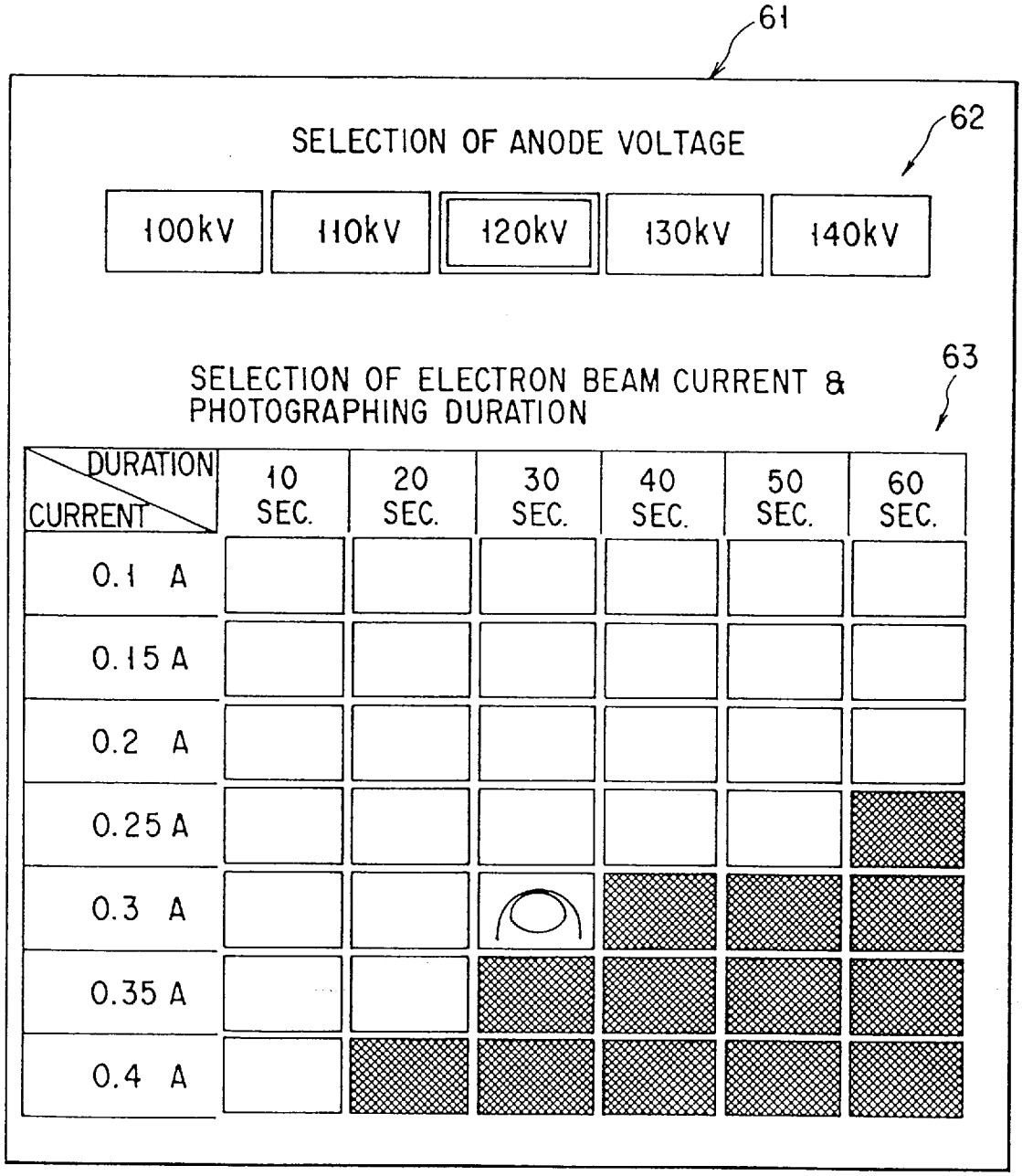
FIG. 10 is a schematic front view of the panel of FIG. 5;.

In the CT scanner, the emission of X rays from the X-ray tube 31 is controlled by the X-ray emission control device 29 as described above. The control panel 61 of the X-ray emission control device 29 includes a touch sensor switch-type CRT display and operation screen as shown in FIG. 10, for example. FIG. 10 illustrates an embodiment in a case where tomographic images are photographed in the helical scanning mode. The control panel 61 includes an anode voltage select section 62 that enables the user to choose and set an anode voltage applied to the X-ray tube 31 and an electron beam current and photographing duration select section 63 that enables the user to choose an electron beam current entering the rotary anode 40 of the X-ray tube 31 and an X-ray photographing duration or X-ray emission duration.

The anode voltage select section 62 enables the anode voltage to be chosen at intervals of 10 kV in the range from 100 kV to 140 kV. The X-ray tube 31 is energized at the selected anode voltage. The electron beam current and photographing duration select section 63 enables the electron beam current to be chosen at intervals of 0.05 A in the range from 0.1 A to 0.4 A and the X-ray photographing duration at intervals of 10 seconds in the range from 10 to 60 seconds. The selected electron beam current is given to the rotary anode 40 of the X-ray tube 31. X-ray radiation is done for the selected photographing duration.

When the operator judges an anode voltage to be optimal according to the state of the subject Ob and chooses the voltage by touching the corresponding position on the anode voltage select section 62 with a finger, the anode acceleration voltage is applied to the X-ray tube 31 during operation. Similarly, when the operator judges an electron beam current and photographing duration to be optimal and chooses the electron beam current and photographing duration by touching the corresponding positions on the electron beam current and photographing duration select section 63 with a finger, X-ray radiation is done under the input conditions during operation.

Then, at any point in time after the start of the X-ray apparatus, the electron beam current and photographing duration select section 63 displays the electron beam current and X-ray radiation duration that enable the current to enter the rotary anode 40 in the X-ray tube 31 without causing damage to the anode 40, such as melting, thereby informing the operator of the items that can be inputted. The example of the display shown in FIG. 10 indicates that photographing is inhibited at an anode voltage of 120 kV under the photographing input conditions shown by crosshatching (actually, for example, red representation) at the intersections of the electron beam current and X-ray radiation duration, because the maximum temperature at the electron beam incident point P and in its vicinity on the rotary anode 40 in the X-ray tube 31 exceeds the tolerance limit Ts.

On the other hand, under the photographing conditions shown by the plain pattern (actually, for example, green representation), the maximum temperature at the electron beam incident point or in its vicinity on the rotary anode 40 is lower than the tolerance limit Ts, which means the photographing can be completed under the conditions. The selection places that indicate input conditions under which the photographing is inhibited or permitted are subjected to a comparison computing process every moment after the start of the apparatus, and the contents of the display are updated.

Figure 4A:
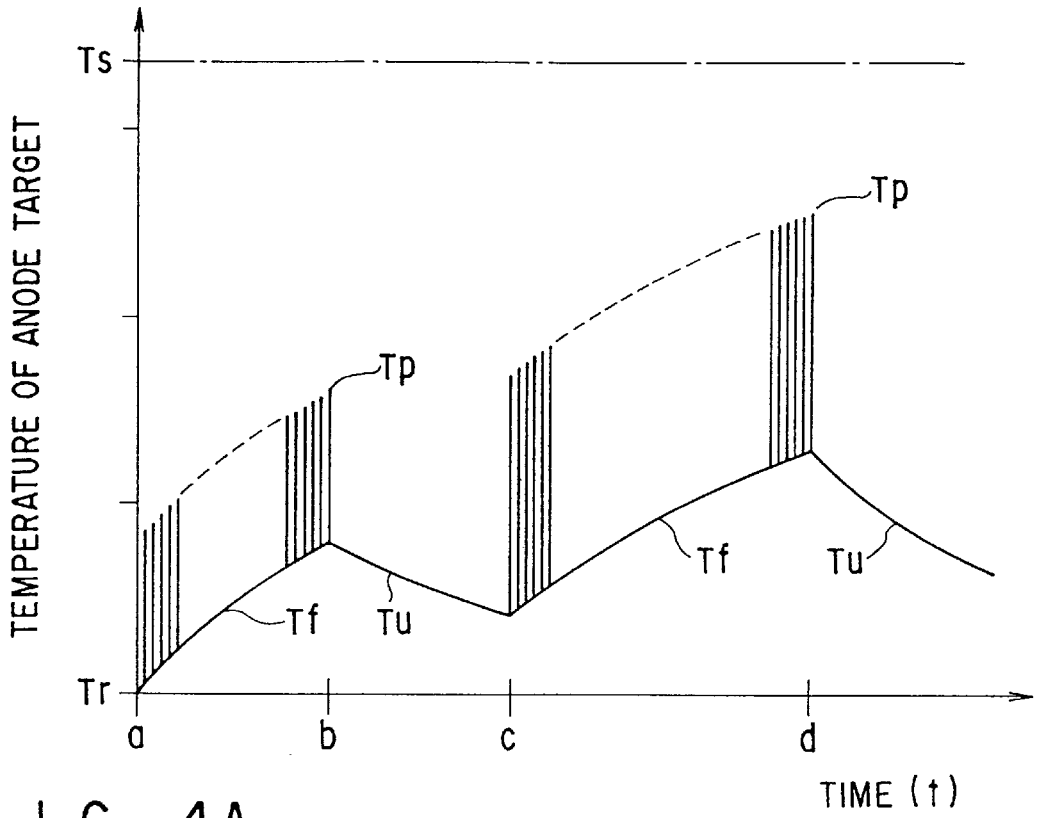
FIGS. 4A and 4B are graphs representing how the anode temperature of the rotary anode of FIGS. 3A and 3B changes with time.
Figure 4B:
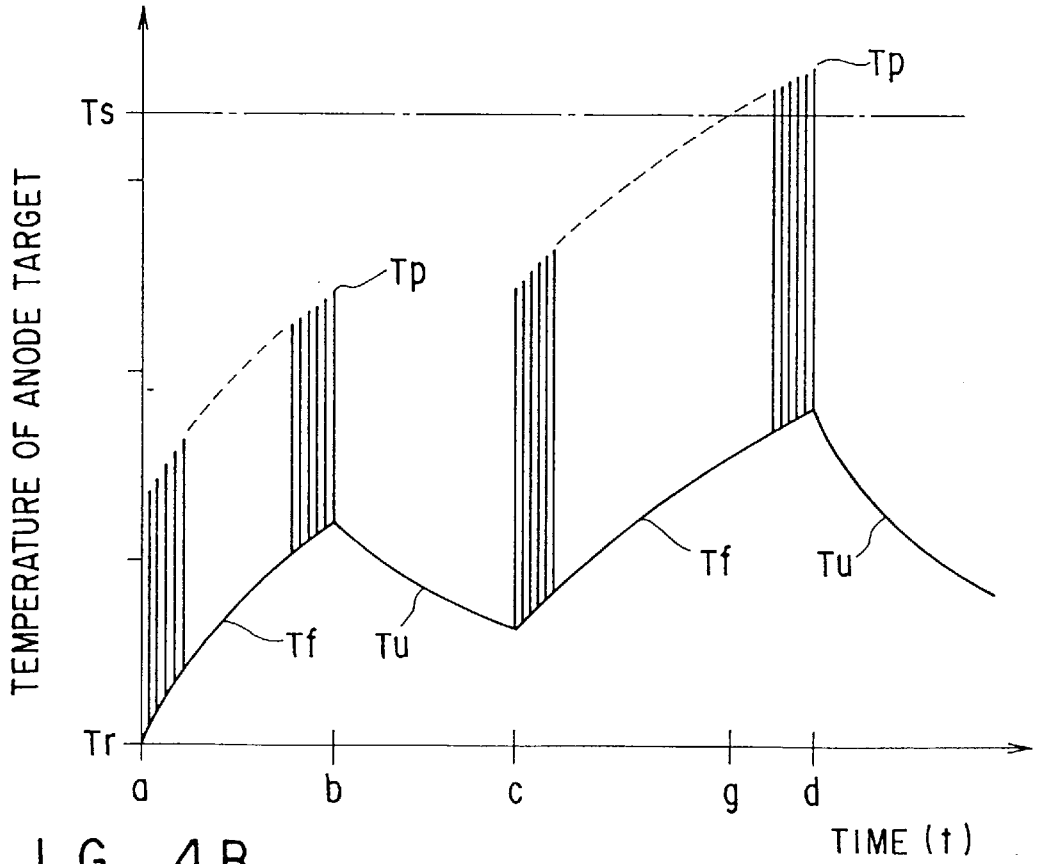

Means for displaying or notifying the input conditions under which operation is inhibited or permitted under various X-ray radiation conditions can be constructed as follows. As seen from the explanation based on FIGS. 4A and 4B, the temperature-rising characteristic of the rotary anode in emitting X rays and the temperature-falling characteristic during heat dissipation are almost determined by the thermal capacity and support structure of the X-ray tube or the rotational rate of the anode and the input conditions, so that the prediction of the change with time for each condition can be calculated quantitatively in advance, or the equations for these calculations and the predicted values can be stored in the computer, thereby making automatic calculations at the beginning of photographing.

Such automatic control, as well as calculations and storage, can be performed by a computer using the following approximate equation in the thesis described in Toshiba Review, Vol. 37, No. 9, pp. 777–780.

If the temperature at the electron beam incident point is Tp and the average temperature in the focal point track area is Tf, the approximate equation will be expressed as:

$$Tp=Tf+(2\cdot P_0\cdot w^{-1/2})/[S(\pi\cdot\rho\cdot C\cdot\lambda\cdot v)^{-1/2}]$$

where P is the incident electric power of the electron beam, w is the width of the electron beam in the direction in which the anode rotates, s is the area of the electron incident surface, ρ is the density of the material of the anode surface section, C is the specific heat of the material, λ is the thermal conductivity of the material, and v is the peripheral speed at the electron beam incident point. The amount of heat dissipated by radiation and conduction from and by the rotary anode 40, rotary structure 35, and stationary structure 42 is included in the equation for the average temperature Tf in the focal point track area.

Thus, for the built-in X-ray tube, the average temperature (Tf) in the focal point track area on the rotary anode and rising changes and falling changes in the temperature (Tp) at the electron beam incident point can be calculated and stored by CPU 29*a* using the rotational rate of the anode, the anode voltage, the electron beam current, and the X-ray emission duration as parameters. Therefore, when input conditions at a certain point in time are determined, the allowable photographing conditions that prevent damage (e.g., melting) from being done to the rotary anode can be automatically computed by the CPU 29*a* on the basis of the determined input conditions. Then, the CPU 29*a* can display on the panel 61 the resulting photographing conditions to inform the operator.

Here, it is assumed that in a case where the temperature of the rotary anode 40 is almost at room temperature (Tr) as, for example, in a case where X-ray radiation is done first thing after the start of the X-ray apparatus, when the operator has chosen an anode acceleration voltage of 120 kV for the first tomography, the display at the current and photographing duration select section 63 is as shown in FIG. 10. Furthermore, it is assumed that the operator has chosen and set an electron beam current of 0.3 A and a photographing duration of 30 seconds for the photographing conditions suitable for taking photographs of the subject Ob.

Then, on the input conditions to the X-ray tube 31, the X-ray emission control device 29 sends a control signal to the X-ray tube power supply 27 and the other related circuitry 24 and 28, thereby operating the X-ray tube device. In this case, for the sake of explanation, the rotational rate of the anode 40 is assumed to be, for example, at a constant speed of 50 rps.

Figure 11:
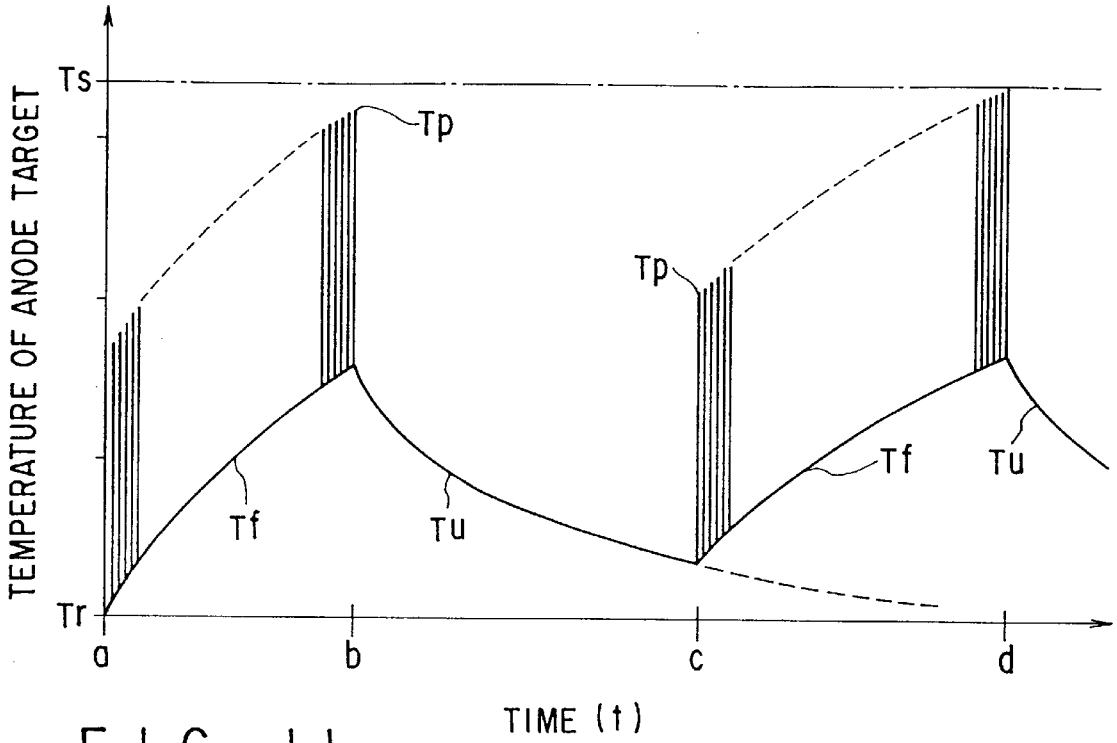
FIG. 11 is a graph representing how the temperature of the rotary anode in the X-ray tube device of FIG. 5 varies with time.

When X-ray radiation is started under the input conditions, this causes the temperature of the rotary anode 40 in the X-ray tube 31 to rise from the X-ray emission start time a to the photographing end time b according to a rising curve (Tf, Tp) under the input conditions as shown in FIG. 11. Thereafter, a timer provided in the CPU 29*a* is started and the temperature in the focal point track area drops from the reached temperature according to a specific falling curve (Tu) because of heat dissipation. Such temperature changes are subjected to comparison and calculation every moment on the basis of the equations or predicted values previously stored in the CPU 29*a* in the X-ray emission control device 29 as described above, on the basis of an output of the timer provided in the CPU 29*a*.

At time b that the first photographing has been completed, the input conditions under which next X-ray radiation is permitted and inhibited without damage to the rotary anode 40 are determined by calculations every moment according to the temperature drop curve (Tu) for the focal point track area. The results are displayed on the section 63 of the panel 61 of FIG. 10 and updated every moment. Specifically, at a point in time when the average temperature in the focal point track area is relatively high, only relatively small electron beam currents and relatively short photographing durations are permitted as allowable input conditions for the next photography, so that representation is displayed according to the conditions. Then, the temperature in the focal point track area drops gradually as shown by the curve Tu and thereafter, the electron beam current and photographing duration that can be inputted increase accordingly, with the result that the electron beam current and photographing duration are updated one after another and the allowable display range is extended gradually toward the larger input conditions.

It is assumed that the next photographing conditions that the operator has determined are such that, for example, the electron beam current is 0.3 A and the photographing duration is 40 seconds. It can be predicted from calculations at the CPU 29*a* in unit 29 that at a point in time shortly after time b that the first photographing has finished shown in FIG. 11, photographing for a relatively short time will cause the temperature (Tp) at the electron beam incident point to exceed the tolerance limit (Ts) under the above-described photographing conditions and therefore the rotary anode will be melted locally. Therefore, according to the photographing conditions, the display area that inhibits photography gets wider on the display panel.

Then, when time c has been reached that it is predicted that the temperature (Tp) at the electron beam incident point will not exceed the tolerance limit (Ts) under the above photographing conditions, the photography inhibition display position, at this point in time, is automatically replaced with a photography permission display position on the display panel 61 according to the same photographing conditions. Therefore, when the operator touches the corresponding position on the display panel 61 with a finger, control will be started so that X-ray radiation may be done under the photographing conditions, with the result that the temperature (Tp) at the electron beam incident point will not reach the tolerance limit (Ts) and the X-ray radiation will be completed at time d that photographing under the above settings will finish. From this time on, by the same processes, X-ray radiation permission or inhibition conditions are displayed and control is performed according to the conditions.

When the selection of the voltage value on the anode voltage select panel section 62 has been changed, the permission or inhibition conditions for the electron beam current value and photographing duration are calculated automatically according to the change. The calculation results are updated and displayed every moment.

As described earlier, the temperature (Tp) at the electron beam incident point varies almost in reverse proportion to the square root of the rotational rate of the anode 40. Namely, even if the anode voltage and electron beam current are constant, when the rotational rate of the anode 40 drops, the temperature (Tp) at the electron beam incident point rises. Taking this into account, the rotational rate of the anode 40 is sensed by, for example, the rotational rate sensor 55 and calculations are made by introducing the value corresponding to the sensed speed into the equations for the photographing permission or inhibition conditions. Then, the display and control are performed on the basis of the calculation results, which enables higher-accuracy display and control.

Figure 12:
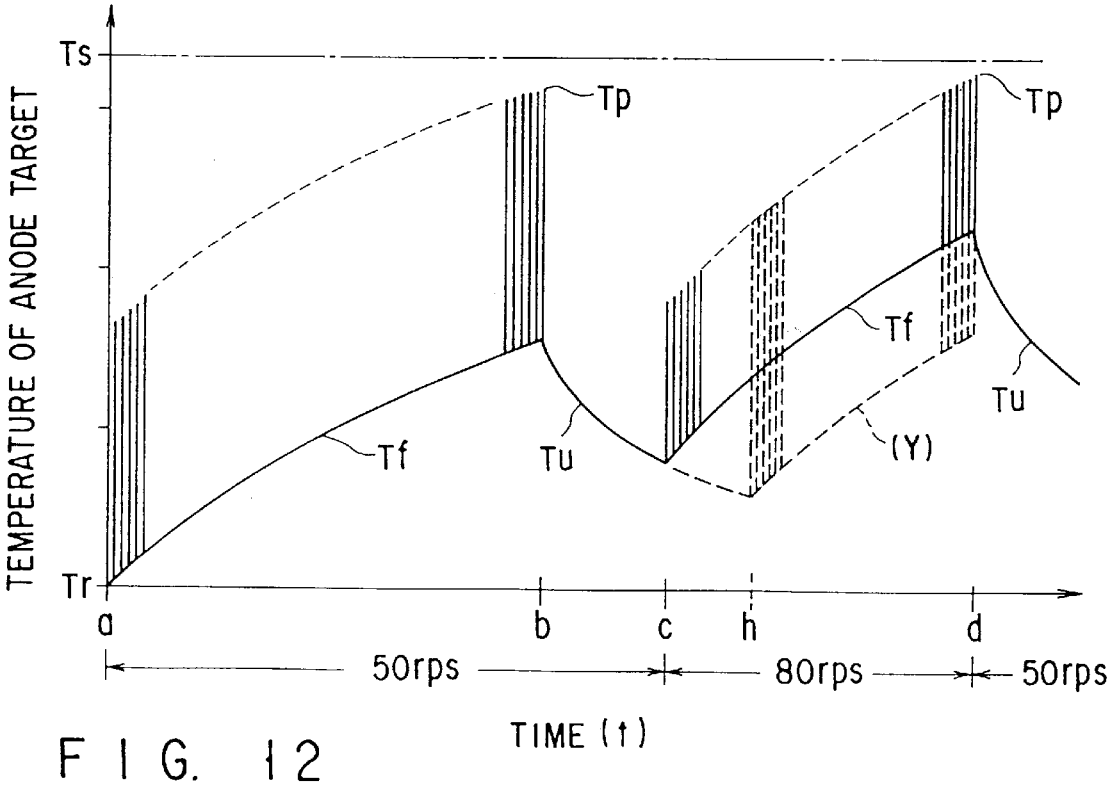
FIG. 12 is another graph representing how the temperature of the rotary anode in the X-ray tube device of FIG. 5 varies with time.

When relatively high input conditions, that is, a higher anode voltage or a larger electron beam current, are selected from the input conditions that can be set for the X-ray apparatus and photographing is done under the selected conditions, the X-ray apparatus may have an automatic control system that makes the rotational rate of the anode faster than under smaller input conditions. For example, as shown in FIG. 12, during the first photographing duration between time a and time b, photographing is done under the conditions where the rotational rate of the anode 40 is set at 50 rps, the electron beam current is set at 0.2 A, and the photographing duration is set at 50 seconds. The average temperature (Tf) in the focal point track area rises relatively slowly, but the temperature (Tp) at the electron beam incident point viewed from the focal point track area is very high.

In contrast, during the next photographing duration between time c and time d during which the electron beam current is set at 0.3 A and the photographing duration is set at 30 seconds, if the rotational rate of the anode is automatically raised to, for example, 80 rps, the temperature (Tp) at the electron beam incident point viewed from the focal point area will stay at a relative low value.

Figure 1:
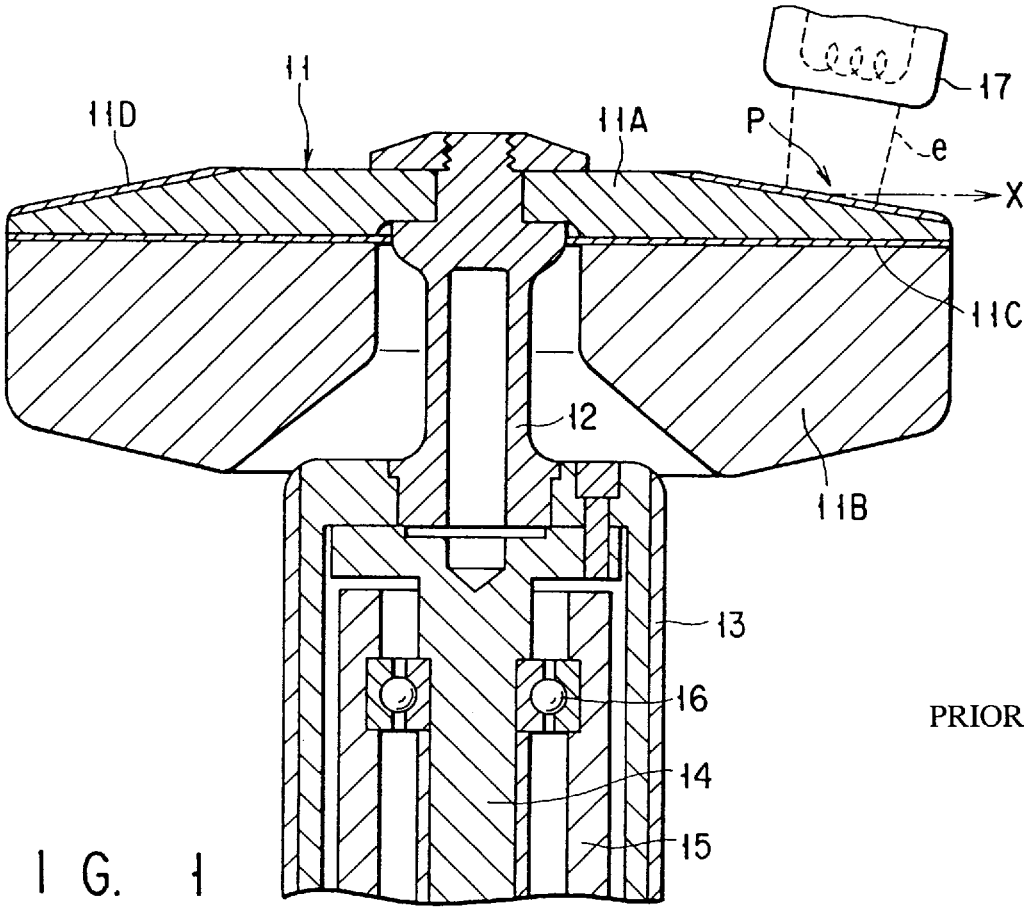
PRIOR ART F I G. 1
FIG. 1 is a longitudinal sectional view of the structure of the anode section of a conventional rotary anode type X-ray tube.
Figure 2:
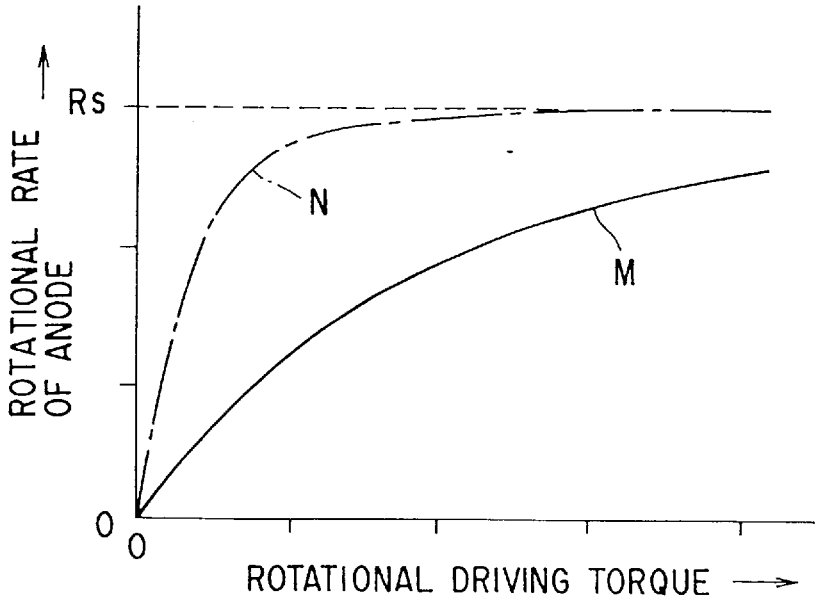
FIG. 2 is a characteristic diagram that shows the relationship between the rotational driving torque and the rotational rate of the anode in the conventional rotary anode type X-ray tube.
Figure 3A:
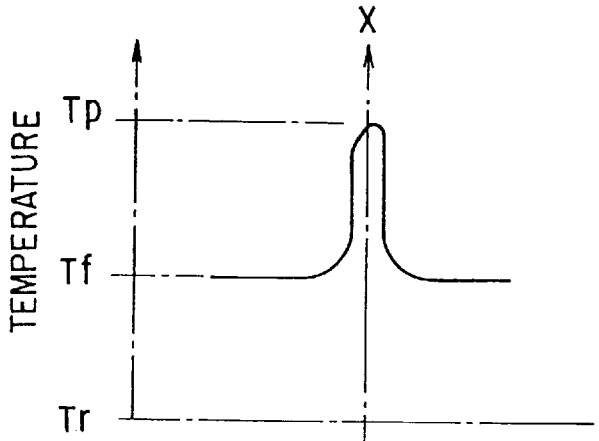
FIG. 3A is a graph representing the temperature distribution on the rotary anode in an ordinary X-ray tube.
Figure 3B:
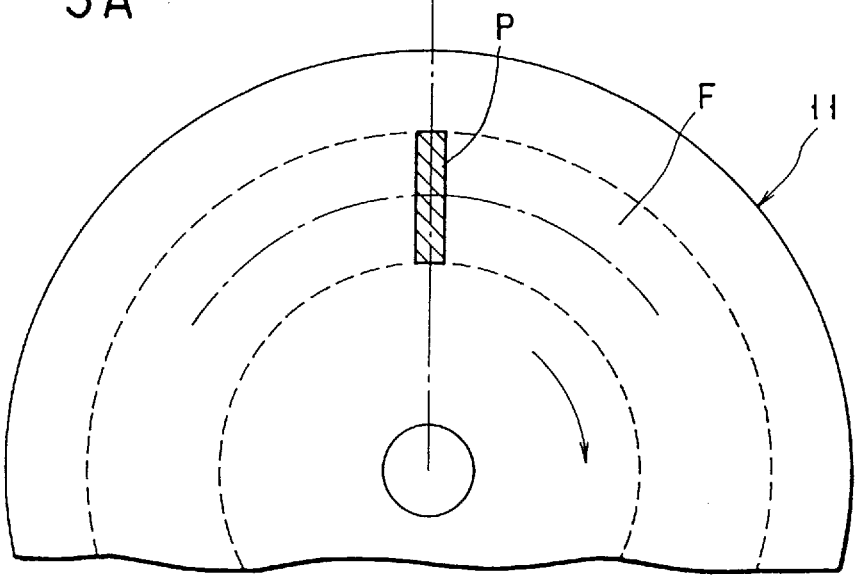
FIG. 3B is a plan view of a part of the rotary anode in the ordinary X-ray tube.

Therefore, with the X-ray tube apparatus with a hydrodynamic slide bearing, the rotational driving torque of the rotary anode 40 increases slightly as shown by curve M in FIG. 2, but this speed control can be performed sufficiently. This makes longer the time required for the temperature at the electron beam incident point to exceed the tolerance limit Ts. Therefore, photographing can not only be started from time c earlier than the photographing start permission time h in a case where photographing is done at the same rotational rate of 50 rps as before (the temperature rising curve Y shown by a dashed line) but also be continued for a long time. In other words, photographing can be done under much higher input conditions.

As described above, the X-ray apparatus can be constructed so that the rotational rate of the anode may be automatically controlled, depending on how high or low the input conditions are, and the permission or inhibition conditions taking into account how high or low the input conditions are, may be displayed or noticed.

By controlling the rotational rate of the anode 40 in the X-ray tube 31 during X-ray radiation so that the speed may fall in the range from 40 to 100 rps, the apparatus can be operated without increasing the rotational driving electric power or doing damage to the rotary anode 40.

Figure 13:
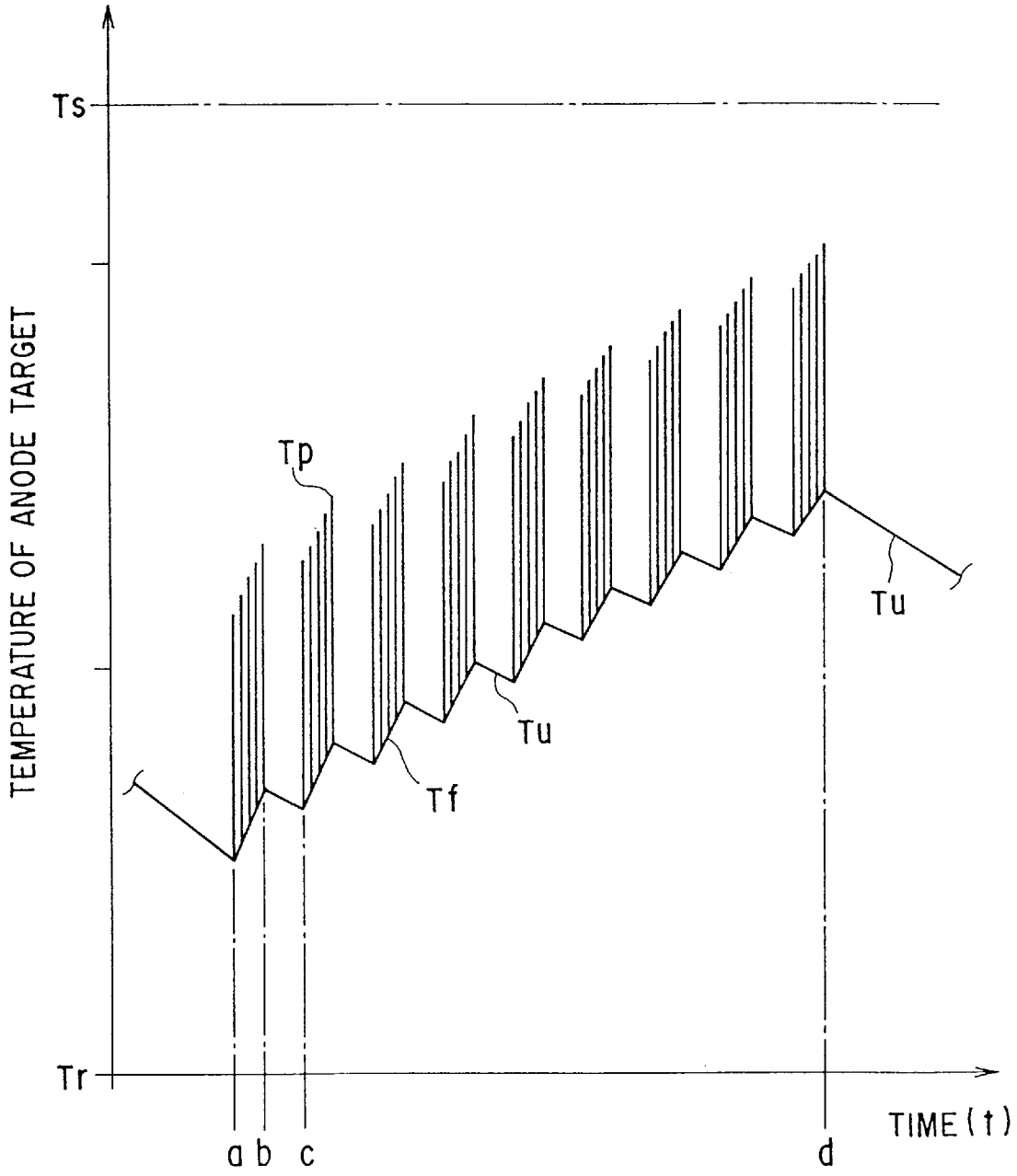
FIG. 13 is still another graph representing how the temperature of the rotary anode in the X-ray tube device of FIG. 5 varies with time.

FIG. 13 shows an embodiment in a case where several tens of slices or several tens of tomograms are taken in short-time intermittent photography. In FIG. 13, a total of nine slices of tomograms are taken at intervals of 2.5 seconds. Specifically, in one second from the first photographing start time a, the X-ray tube 31 and the gantry rotary section 22 carrying the X-ray sensor Dt rotate around the subject Ob, thereby taking one slice of tomogram. The X-ray emission for one second starting from time a to time b causes the average temperature Tf in the focal point track area of the rotary anode 40 and the temperature Tp at the electron beam incident point to rise. Then, during the time from time b that the first slice of photograph has been taken until time c 1.5 seconds later than time b, the bed 23 moves a predetermined distance and the next adjacent region to be photographed starts to be photographed at time c. As a result, the emission of X rays is suspended for the 1.5 seconds, so that the temperature of the rotary anode 40 drops as shown in FIG. 13. In this way, nine slices of tomograms are taken one after another. From time d that a series of photographs have been taken, the temperature of the rotary anode drops gradually from the reached average temperature according to a specific falling curve Tu.

As seen from what has been explained, in the case of the photograph mode in which X-ray radiation is repeated a specific number of times at regular intervals of time, too, the apparatus can be constructed so that the temperature rise and fall of the rotary anode may be calculated, comparison may be made on the basis of the equations or predicted values, and the photographing permission and inhibition conditions at every moment may be displayed or notified to the operator.

The means for displaying or notifying the photographing permission or inhibition conditions every moment is not limited to that of FIG. 10, but may be a display unit used for a conventional CT scanner. Namely, for example, the ratio of the amount of heat accumulated every moment to the maximum amount of input heat to the rotary anode, the next photographing conditions and the waiting time until X-ray radiation is permitted under the conditions, etc. may be calculated every moment and be updated and displayed.

While in the embodiment, the temperature of the rotary anode excluding the electron beam incident point is expressed by the average temperature in the focal point track area excluding the electron beam incident point, the average temperature may be replaced with, for example, the temperature in a specific position near the focal point track area of the rotary anode. Alternatively, the average temperature may be replaced with the average temperature of the entire base of the rotary anode. Still alternatively, the temperature in a specific position on the rotary anode may be actually sensed by a temperature sensor and the sensed signal or obtained value may be subjected to a computing process, which will enable a higher-accuracy prediction process.

The present invention is not restricted to tomography by X-ray emission for a relatively long time, but may be applied to a wide variety of applications, including normal circulatory organ photography, X-ray emission for a relatively short time, X-ray lithography, and other industrial X-ray apparatuses.

As described so far, with the present invention, because X-ray radiation conditions that prevent damage, such as local melting, from being caused to the rotary anode in the X-ray tube are displayed or notified every moment, X-ray radiation can always be done under safe, high-accuracy, high-efficiency, and best photographing conditions.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. An X-ray apparatus comprising:

an X-ray tube including:

a rotary anode having an X-ray emitting target;

a cathode that emits an electron beam toward said target of the rotary anode a rotary structure to which the anode is secured;

a stationary structure that engages concentrically with the rotary structure; and a hydrodynamic slide bearing which has helical grooves in an engaging section of the rotary structure and stationary structure and to which a liquid-metal lubricant with a specific melting point is applied;

a stator arranged around an outside periphery of the X-ray tube;

a rotational driving power supply device that supplies a rotational driving electric power to the stator;

a X-ray tube power supply device that causes an electron beam to strike an focal point track area on the rotary anode in the X-ray tube; and an X-ray emission control device that controls an operation of the X-ray tube power supply device and sets conditions of X-ray emission, wherein said X-ray emission control device includes:

first prediction means that predicts how a temperature at an electron beam incident point on said focal point track area and an average temperature of said focal point track area rise with time for the anode voltage, electron beam current and the electron beam incidence duration in a case where an electron beam is caused to strike the focal point track area on the rotary anode in the X-ray tube;

second prediction means that predicts how the average temperature of the focal point track area falls with time from the reached average temperature of the focal point track area by heat dissipation in a case where the electron beam incidence is stopped; and notifying means for notifying at every moment input permission conditions to the X-ray tube obtained on the basis of prediction results from said first and second prediction means.

2. An X-ray apparatus according to claim 1, wherein the rotary anode in the X-ray tube is composed of a base section made of a high melting-point metal and a target section formed on said base section.

3. An X-ray apparatus according to claim 2, wherein said base section and target section are made of the same high melting-point metal.

4. An X-ray apparatus according to claim 1, wherein the notifying means has a touching switch that notifying input permission conditions and when said touching switch that notifies said input permission conditions is selected, the control device is driven so that X rays may be emitted from the X-ray tube under the input conditions.

5. An X-ray apparatus according to claim 1, further comprising a sensing unit that senses the rotational rate of the anode, wherein the control device includes means that calculates input permission conditions, taking into account the data corresponding to the rotational rate of the anode sensed by the sensing unit.

6. An X-ray apparatus according to claim 1, further comprising control means that controls the rotational rate of the anode, when a condition of X-ray emission is changed.

7. An X-ray apparatus according to claim 1, wherein the rotational rate of the anode in the X-ray tube at the time of X-ray emission is set in the range from 40 to 100 revolutions per second.

8. An X-ray apparatus according to claim 1, wherein the X-ray tube and an X-ray sensor are provided on a gantry rotating section arranged around the place in which a subject to be photographed is positioned, and the gantry rotating section rotates around the subject in taking X-ray photographs, thereby taking photographing tomographic images.

* * * * *